US005323850A

United States Patent [19]

Roberts

[11] Patent Number: 5,323,850

[45] Date of Patent: Jun. 28, 1994

[54] STEAM COIL WITH ALTERNATING ROW OPPOSITE END FEED

[76] Inventor: Thomas H. Roberts, 1417 E. Meadow La., Olathe, Kans. 66062

[21] Appl. No.: 38,018

[22] Filed: Mar. 29, 1993

[51] Int. Cl.[5] ..... F28F 13/06

[52] U.S. Cl. ..... 165/174; 165/151; 165/908

[58] Field of Search ..... 165/174, 176, 908, 172, 165/151

[56] References Cited

U.S. PATENT DOCUMENTS

| | | | |
|---|---|---|---|
| 2,098,830 | 11/1937 | McElgin | 165/174 |
| 2,229,032 | 1/1941 | Ashley | 165/174 X |
| 2,611,584 | 9/1952 | Labus | 165/151 |
| 2,614,816 | 10/1952 | Hull | 165/110 |
| 2,816,738 | 12/1957 | McElgin | 165/151 |
| 2,991,978 | 7/1961 | Jones | 165/174 X |
| 3,067,818 | 12/1962 | Ware et al. | 165/174 |
| 3,229,761 | 1/1966 | Ware | 165/142 |
| 4,116,271 | 9/1978 | De Lepeleire | 165/166 |
| 4,458,750 | 7/1984 | Huber | 165/174 |
| 4,609,039 | 9/1986 | Fushiki et al. | 165/174 |
| 5,157,935 | 10/1992 | Gregory | 62/278 |

*Primary Examiner*—Allen J. Flanigan

*Attorney, Agent, or Firm*—Hovey, Williams, Timmons & Collins

[57] ABSTRACT

A steam coil apparatus for transferring heat between steam passing through the apparatus and air flowing past the apparatus, the apparatus including a plurality of spaced outlet tubes extending substantially parallel to one another in a direction generally transverse to the direction of flow of the second fluid, and a plurality of fins or other extended surface attached to the outlet tubes and extending generally transverse to the outlet tubes. A plurality of inlet tubes are provided, each being received within one of the outlet tubes and formed of a diameter smaller than the diameter of the outlet tube within which it is received. The inlet tubes are provided with axially spaced orifices through which the first fluid passes from the inlet tubes to the outlet tubes. An outlet header is provided in fluid communication with the outlet tubes, and first and second opposed inlet headers communicate with the inlet tubes. The first inlet header communicates with a first set of the inlet tubes and the second inlet header communicates with a second set of the inlet tubes, wherein each inlet tube of the first set is spaced from each adjacent inlet tube in the first set by an inlet tube of the second set.

4 Claims, 2 Drawing Sheets

STEAM COIL WITH ALTERNATING ROW OPPOSITE END FEED

BACKGROUND OF THE INVENTION

1. Field of the Invention

The present invention relates generally to heat exchangers and, more particularly, to a steam coil apparatus having opposed inlet headers which feed steam into alternating rows of tubes in order to provide for more even distribution of the steam through the apparatus.

2. Discussion of the Prior Art

It is known to provide a steam heater including a plurality of generally horizontally extending outer tubes extending across a region past which air flows during heating of the air. In such devices steam and the resulting hot condensate water is delivered to the outer tubes via inner tubes received therein. The inner tubes receive steam from a laterally disposed inlet header, and are provided with spaced-apart openings which discharge steam into the concentric outer tubes. An example of such a device is illustrated in U.S. Pat. No. 2,991,978 to Jones, issued Jul. 11, 1961.

This general type of device remains in use today in ventilators, heaters and air conditioning systems, for transferring heat between the steam supplied to the apparatus and air flowing past the device. During normal operation, at steam pressures of 2–5 psig or greater, steam from the inlet header fills the inner tubes and is forced somewhat evenly under the pressure into the concentric outer tubes and delivered from the device. This even distribution of the steam through and along the inner tubes provides an even distribution of heat across the fins connected to the outer tubes so that the temperature of air passing the device is raised evenly, with few isolated, localized hot spots or cold spots forming.

A drawback to the conventional construction arises when the pressure of the steam fed to the apparatus drops below the design full load operating pressure, and is magnified at very low pressures of below 2 psig. It is often necessary to operate a steam coil apparatus at such low pressures in order to obtain the desired heating capacity of the heat exchanger. However, when such low pressures are employed in the conventional construction, hot spots and cold spots develop in the streams of air passing across the device, which can cause the system which the apparatus is installed within to malfunction or freeze under certain circumstances.

For example, it is known to employ a steam coil in a ventilation system for hospitals, laboratories or the like, wherein the steam coil is used to warm incoming, outdoor air to a desired, controlled temperature (e.g. 45° F.) as the preheat coil in the air conditioning system which also utilizes chilled water coils in the same system. Typically, the chilled water coil is located from 1–6 feet downstream of the heating coil such that any stratification of temperature across the air stream remains substantially unchanged between the steam coil and the chilled water coil.

Where a safety assembly is included in the air conditioning system for shutting down the system when the temperature of the air entering the chilled water coil is below a predetermined temperature (such as 38° F.) the possibility arises that cool air from within a localized cold spot will trip a sensor of the safety assembly causing the system to shut down even though the average temperature of the air reaching the chilled water coil is still at the desired operating temperature. Alternatively, without safety shutdown, the localized cold spot could result in freezing in the chilled water coil and resulting damage and repairs.

These localized hot spots and cold spots are created by uneven distribution of steam within the steam coil. At low pressures, steam fed to the inlet tubes of the conventional construction travels to the distal ends of the tubes before passing through the holes to the concentric outer tubes. Or, in the case of a steam coil with inner tubes supplied from both ends; steam fed to the inlet tubes travels to the midpoint of the tube length before passing through the holes to the concentric outer tube. This uneven distribution which occurs within each inner tube is due to the inertia of the fluid and causes the temperature at the distal end of each tube or the midpoint, in the case of the coil supplied from both ends, to rise above the temperature at the proximal end thereof. Because steam is fed to all of the inner tubes in the same direction, the temperature along the lateral side of the steam coil aligned with the distal ends of the inlet pipes increases or the midpoint, in the case of the coil supplied from both ends, while the temperature along the opposing lateral side of the steam coil drops.

When the temperature of the incoming, ambient air drops below freezing, and the steam coil is operated at lower than design steam supply pressures, the localization of heat at the distal ends of the inlet tubes heats the air to a temperature much greater than that desired, while air adjacent the proximal ends of the inlet tubes may allow water within the steam coil or the downstream chilled water coil to freeze. This extreme variation within the steam coil can cause failure of the device, or of the downstream system components (e.g. chilled water coil), or safety shutdown of the system.

OBJECTS AND SUMMARY OF THE INVENTION

It is an object of the present invention to provide a steam coil apparatus in which steam is more evenly distributed across the area of heat exchanger, even when the apparatus is employed at low operating pressures.

It is a further object of the present invention to provide a steam coil apparatus in which stratification of the temperature within air streams passing across the apparatus are substantially removed to improve the reliability, efficiency, and operational stability of the steam coil apparatus.

In accordance with these and other objects evident from the following description of a preferred embodiment of the invention, a heat exchange apparatus is provided for transferring heat between a first fluid passing through the apparatus and a second fluid flowing past the apparatus. The apparatus comprises a plurality of spaced outlet tubes extending substantially parallel to one another in a direction generally transverse to the direction of flow of the second fluid. A plurality of inlet tubes are provided which are divided into first and second sets. Each inlet tube is received within one of the outlet tubes and is formed of a diameter smaller than the diameter of the outlet tube within which it is received. The inlet tubes are also provided with axially spaced orifices through which the first fluid passes from the inlet tubes to the outlet tubes.

An outlet header is in fluid communication with the outlet tubes, and first and second opposed inlet headers are located at opposite ends of the outlet tubes. The first inlet header communicates with the first set of the inlet tubes and the second inlet header communicates with the second set of the inlet tubes. Each inlet tube of the first set is spaced from each adjacent inlet tube in the first set by an inlet tube of the second set. A plurality of fins are attached to the outlet tubes and extend generally transverse to the outlet tubes.

By providing this construction, numerous advantage are realized. For example, by feeding steam into one end of the first set of inlet tubes and into the opposite end of the second set, and by interposing an inlet tube of the second set of tubes between each pair of inlet tubes of the first set, the position of the distal ends of the inlet tubes alternates between opposite sides of the apparatus. When steam is then fed to the inlet tubes at low pressures, it is unevenly distributed within each inlet tube and the temperature of the distal end of the tube is greater than the proximal end. However, because the orientation of the tubes alternates across the height of the apparatus, the hot spot at the distal end of each inlet tube is located adjacent the cold spot of an adjacent inlet tube of the other set. In this manner, the temperature of air flowing past the apparatus is equalized, preventing the development of hot spots or cold spots as severe as experienced in the prior art.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
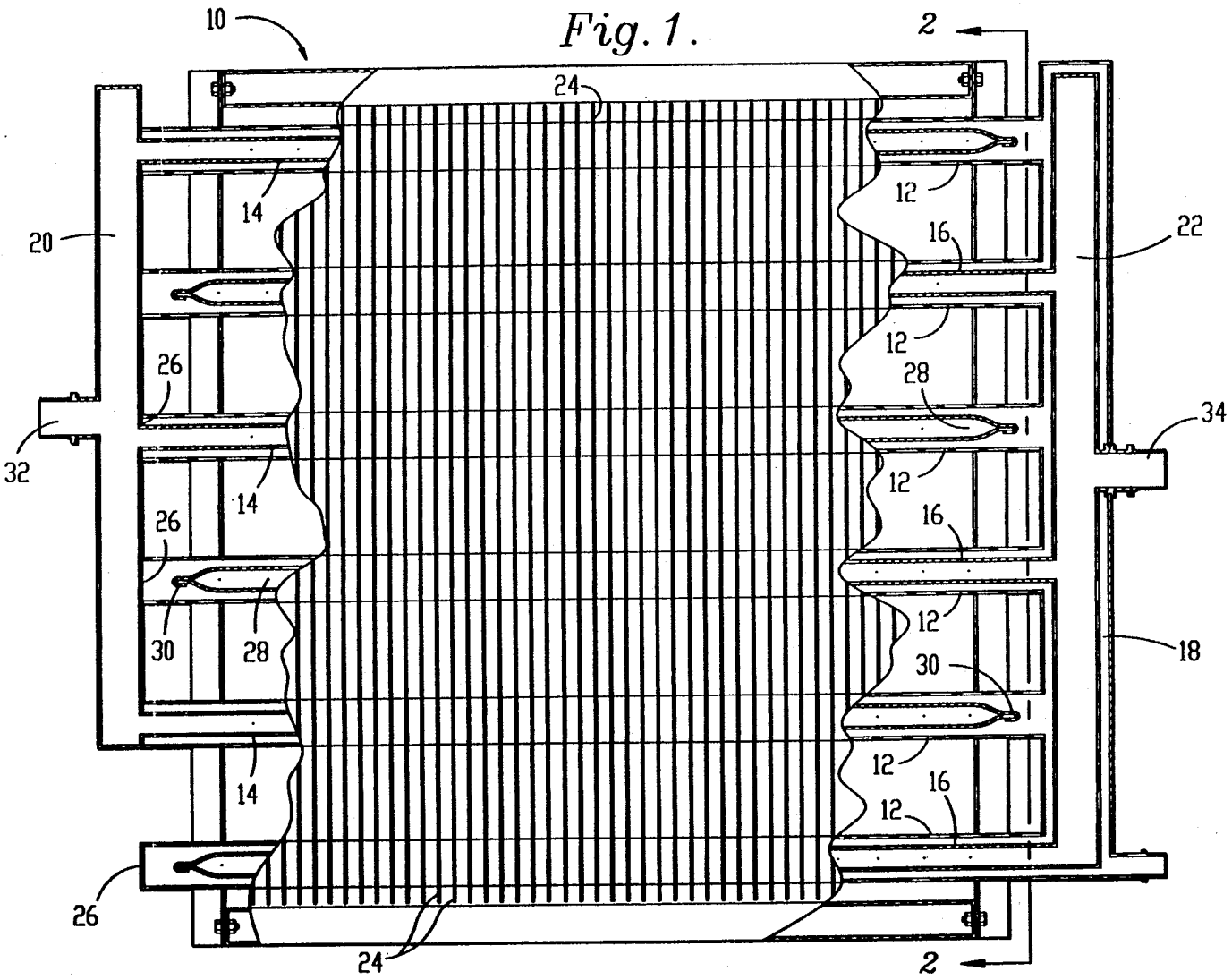
FIG. 1 is a front elevational view, partially in section, of a steam coil apparatus constructed in accordance with the preferred embodiment.

A heat exchange apparatus constructed in accordance with a preferred embodiment of the present invention is illustrated in FIG. 1, and is designed for use in transferring heat between a first fluid passing through the apparatus and a second fluid flowing past the apparatus.

The apparatus is preferably a steam coil apparatus which uses steam to heat air flowing past the steam coil to a downstream ventilation system, distribution system, air conditioning device, or other point of use for the heated airstream. The apparatus broadly includes a frame 10, a plurality of horizontally extending outlet tubes 12 supported on the frame, a plurality of inlet tubes 14, 16, an outlet header 18, a pair of inlet headers 20, 22, and a number of heat transfer fins 24, or other extended surface area, connected to the outer tubes and extending in a direction generally transverse to the outer tubes.

The frame 10 may be formed of any desired material, and is sized for receipt within a ventilation duct, ventilization or air handling unit cabinet, housing, or similar structure through which air is passed. The outlet tubes 12 extend across the frame horizontally, although it is also possible to orient the tubes vertically. Also, it is possible to incline the outer tubes at a slight angle to horizontal relative to the frame so that liquid within the outer tubes drains toward the outlet header 18 for delivery from the apparatus.

The outlet tubes 12 are formed of any desired heat conductive material, such as copper, and are tubular in shape, having a diameter large enough to receive the inlet tubes 14, 16. For example, in an exemplary system, the outer tubes may be of an inner diameter of about an inch, and may be spaced from one another vertically by a distance of about three inches on center.

The outlet header 18 extends along the entire height of the apparatus at one lateral side thereof, and is connected to the same end of each of the outlet tubes 12 so that steam and water within all of the outlet tubes travel in the same direction toward the outlet header. In this manner, all of the outlet tubes may be inclined at the same angle and in the same direction as one another in order to improve the flow of condensate water from the apparatus.

The distal end 26 of each outlet tube 12, opposite the proximal end connected to the outlet header 18, is closed by an end plate, formed either by a separate piece of material or by engagement between the outlet tube and the inlet header. Thus, steam and water are prevented from passing out the distal end of the outlet tubes.

The inlet tubes are divided into first and second sets 14, 16, and each inlet tube is received within one of the outlet tubes 12 and is formed of a diameter smaller than the inner diameter of the outlet tube within which it is received so that an annular space is defined between each inlet tube and the associated outlet tube. A plurality of axially spaced, generally radially extending orifices 28 are formed in each inlet tube 14, 16 along the length thereof through which steam passes from the inlet tubes to the outlet tubes. The inlet tubes may be formed of any desired heat conductive material such as copper or the like.

Figure 3:
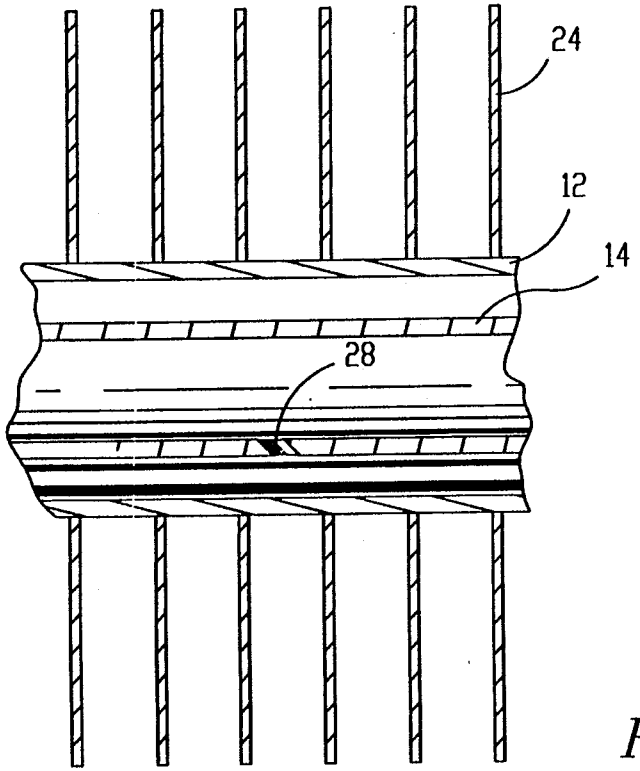
FIG. 3 is a fragmentary sectional view of the apparatus, illustrating the construction of orifices formed in inlet tubes provided in the apparatus.

Turning to FIG. 3, although it is possible to form each orifice 28 as a radially extending hole passing between the interior of the inlet tube and the outlet tube, it is preferred to angle each orifice toward the outlet header 18.

Returning to FIG. 1, the first and second inlet headers 20, 22 are located at opposite ends of the outlet tubes 12, and the first inlet header 20 is in fluid communication with the first set of the inlet tubes 14 while the second inlet header 22 is in fluid communication with the second set of the inlet tubes 16. Thus, each inlet tube 14 of the first set includes an open end connected to the first inlet header 20 at one lateral side of the apparatus and an opposing closed end 30, while each inlet tube 16 of the second set includes an open end connected to the second inlet header 22 opposite the first inlet header 20.

Further, the inlet tubes of the first and second sets are staggered such that each inlet tube 14 of the first set is spaced from each adjacent inlet tube 14 of the first set by an inlet tube 16 of the second set, and vice versa. In other words, the orientation of the inlet tubes 14, 16 alternates in the direction of the height of the apparatus such that the open end of each inlet tube is located immediately above or below the closed ends 30 of the inlet tubes immediately adjacent thereto. The first inlet header 20 is disposed adjacent to the distal ends of the outlet tubes and opens into the inlet tubes 14. The second inlet header 22 is disposed within the outlet header and communicates only with the inlet tubes 16.

As mentioned, the orifices 28 in the inlet tubes are angled toward the outlet header 18 to assist water flow through the device. Although the orientation of every alternate inlet tube 14 is reversed relative to the remaining inlet tubes 16, the angle of the orifices 28 remains constant relative to the outlet tubes since all of the outlet tubes are connected to the outlet header at the same side of the apparatus.

The distal end 30 of each inlet tube 14, 16 is closed, preferably by pinching the material of the tubes together. Alternately, the distal ends of the inlet tubes may be closed by separate end plates which may or may not be provided with orifices therein.

Figure 2:
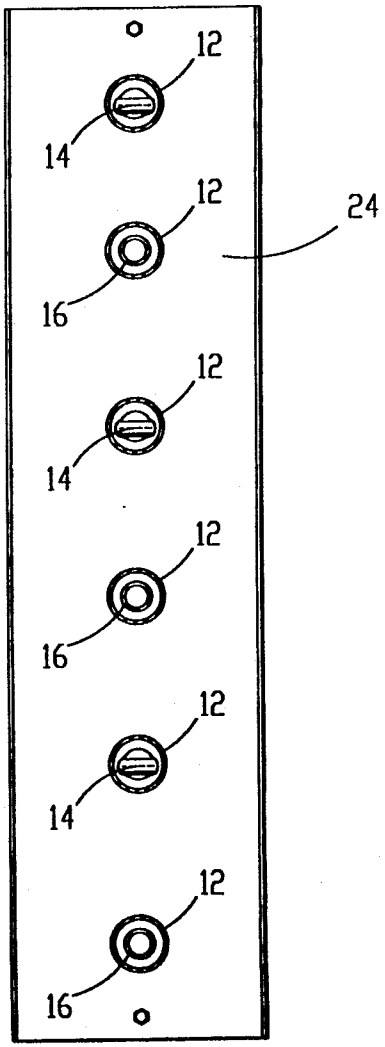
FIG. 2 is a side elevational view of the apparatus.

The fins 24 are attached to the outlet tubes 12 by mechanical expansion, hydraulic expansion, welding or the like, and extend in a direction generally transverse to the outlet tubes. Preferably, the fins 24 are generally flat or articulated plates or other shapes, formed of aluminum, copper, alloys or other heat conductive material, and define air flow passageways through which air travels as it passes across the outer surfaces of the outlet tubes through the ventilation duct, equipment, or other apparatus. As shown in FIG. 2, the fins may be rectangular in shape and extend from the lower end of the apparatus completely across the height thereof.

During operation, steam is fed from a suitable steam generator through inlet conduits 32, 34 into the two inlet headers 20, 22 in relatively equal amounts under equivalent pressure, and passes into the two sets of inlet tubes 14, 16, through the orifices 28, and into the outlet tubes 12. As heat is transferred from the steam to the walls of the inlet and outlet tubes, and as pressure drops during passage of the steam through the apparatus, water condenses within the outlet tubes.

Because the orifices 28 are angled toward the outlet header 18, and due to pressure and/or elevation differences and/or slope of the outer tubes in a direction towards the outlet header 18, steam is released into the outlet tubes in a direction forcing condensate to flow toward the outlet header so that it may be delivered from the apparatus. The steam and water entering the outlet header are drained or returned to the steam generator by a return conduit.

When the steam is introduced under a generally higher pressure, the steam pressure is substantially constant along the entire length of each inlet tube 14, 16, and uniform heat transfer from the steam occurs along the entire length of and the outlet tubes. Heat from the outlet tubes is conducted into the fins and is available for transfer to the air flowing past the apparatus so that the temperature of the air is raised to a desired temperature.

If the heating requirements of the apparatus are reduced, or if the available steam supply pressure is lower, resulting in a lower pressure of the steam introduced to the inlet headers, the distribution of steam and of the heat transferred thereby becomes uneven. Specifically, because the inertia of the steam causes it to travel to the distal ends 30 of the inlet tubes 14, 16, localized heating of the outlet tubes 12 occurs in the region of each inlet tube distal end. However, because the distal ends of the inlet tubes are staggered on opposite sides of the apparatus throughout the height thereof, this localized heating is accompanied by localized cooling in the region of each inlet tube proximal end. In this manner, the average temperature distribution across the height of the apparatus is substantially identical at each position along the length of the outlet tubes, significantly reducing the amount of stratification of temperature within the airstream downstream of the device.

Although the invention has been described with reference to the preferred embodiment illustrated in the attached drawing figures, it is noted that substitutions may be made and equivalents employed herein without departing from the scope of the invention as recited in the claims.

What is claimed is:

1. A heat exchange apparatus for transferring heat between a first fluid passing through the apparatus and a second fluid flowing past the apparatus, the apparatus comprising:

a plurality of spaced outlet tubes extending substantially parallel to one another in a direction generally transverse to the direction of flow of the second fluid, each of the outlet tubes having a predetermined diameter;

a plurality of inlet tubes divided into first and second sets, each inlet tube being received within one of the outlet tubes and being formed of a diameter smaller than the diameter of the outlet tube within which it is received, the inlet tubes being provided with longitudinally spaced orifices through which the first fluid passes from the inlet tubes to the outlet tubes;

an outlet header in fluid communication with the outlet tubes;

first and second opposed inlet headers located at opposite ends of the outlet tubes, the first inlet header being in fluid communication with the first set of the inlet tubes and the second inlet header being in fluid communication with the second set of the inlet tubes, wherein each inlet tube of the first set is spaced from each adjacent inlet tube in the first set by an inlet tube of the second set; and an extended heat exchange surface attached to the outlet tubes and extending generally transverse to the outlet tubes.

2. A heat exchange apparatus as recited in claim 1, wherein the same number of inlet tubes are included in each set.

3. A heat exchange apparatus as recited in claim 1, wherein the inlet tubes each include a longitudinal axis, and the orifices in the tube are angled relative to a radial line extending from the axis.

4. A heat exchange apparatus as recited in claim 1, wherein each inlet header includes a conduit through which the first fluid is introduced into that inlet header.

* * * * *